United States Patent [19]

Watts

[11] Patent Number: 4,931,627

[45] Date of Patent: Jun. 5, 1990

[54] POSITIVE TEMPERATURE COEFFICIENT HEATER WITH DISTRIBUTED HEATING CAPABILITY

[75] Inventor: Leslie M. Watts, Elmhurst, Ill.

[73] Assignee: Illinois Tool Works Inc., Chicago, Ill.

[21] Appl. No.: 379,276

[22] Filed: Jul. 13, 1989

Related U.S. Application Data

[63] Continuation-in-part of Ser. No. 233,271, Aug. 16, 1988, Pat. No. 4,857,711.

[51] Int. Cl.[5] ..... H05B 1/00

[52] U.S. Cl. ..... 219/548; 219/203; 219/219; 219/543; 219/553

[58] Field of Search ..... 219/202, 203, 219, 345, 219/528, 543, 548, 549, 553; 15/250.05

[56] References Cited

U.S. PATENT DOCUMENTS

| | | | |
|---|---|---|---|
| 3,790,748 | 2/1974 | Van Laethem | 219/219 |
| 3,887,788 | 6/1975 | Seibel | 219/543 |
| 4,037,286 | 7/1977 | Medearis | 219/219 |
| 4,628,187 | 12/1986 | Sekiguchi | 219/548 |
| 4,631,391 | 12/1986 | Tiepke | 219/219 |

*Primary Examiner*—Bruce A. Reynolds

*Assistant Examiner*—Leon K. Fuller

*Attorney, Agent, or Firm*—John O'Brien; Thomas W. Buckman

[57] ABSTRACT

A heating device for a mirror includes a substrate having an electrical buss system deposited on one surface thereof including a plurality of interdigitated electrodes and two buss bars. There is provided a plurality of heater-lets formed of an electrically resistive layer of material having a positive temperature coefficient. The plurality of heater-lets have varying sizes and shapes and are deposited over the electrical buss system between the adjacent electrodes of the interdigitated electrodes. Each of the plurality of heater-lets are separated from its neighbor by spaces of varying sizes and shapes so as to form a plurality of individual heating areas of variable intensity. A first adhesive layer is deposited over the resistive layer and adheres to the exposed areas of the substrate. An electrical barrier layer is secured to the first adhesive layer, and a second adhesive layer is disposed on the electrical insulated barrier layer. A removable protective covering is secured to the second adhesive layer. The power distribution over the entire substrate is selectively regulated by varying the density of the heater-lets.

13 Claims, 2 Drawing Sheets

Fig. 1
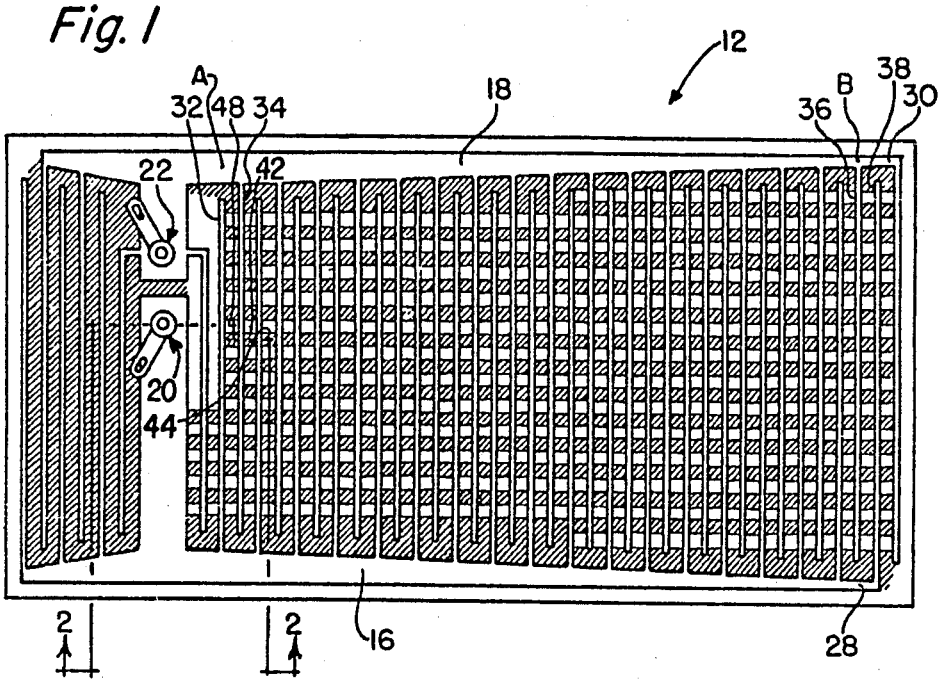
Fig. 2
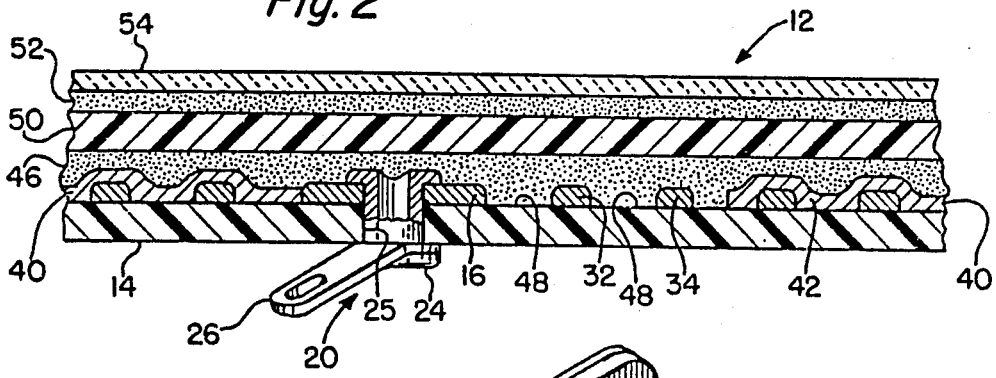
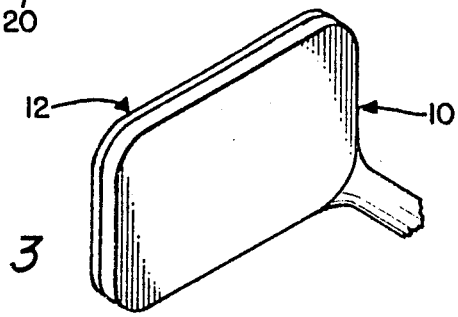
Fig. 3

POSITIVE TEMPERATURE COEFFICIENT HEATER WITH DISTRIBUTED HEATING CAPABILITY

CROSS-REFERENCE TO RELATED APPLICATION

This application is a continuation-in-part of co-pending application Ser. No. 233,271 filed Aug. 16, 1988 now U.S. Pat. No. 4,857,711, and entitled "Positive Temperature Coefficient Heater."

BACKGROUND OF THE INVENTION

This invention relates to a heating device. More particularly, the invention relates to a self regulating heating device. In still greater particularity, the invention relates to a self regulating heater using a positive temperature coefficient (PTC) resistive material specifically adapted for use in heating automotive-type outside rearview mirrors.

Heating devices for glass plates including mirrors using positive temperature coefficient materials have been devised. Two such devices are disclosed in U.S. Pat. Nos. 4,628,187 and 4,631,391. These devices have certain disadvantages and shortcomings which the present invention overcomes. For example the device in U.S. Pat. No. 4.631,391 uses individual spaced apart platelettes of PTC heater elements sandwiched between two heat conductive layers which do not provide uniform heating of the surface to be heated. In the case of U.S. Pat. No. 4,628,187, an area principally at the periphery of the mirror occupied by the electrode material of the heating device is not heated resulting in a significant reduction in mirror heated area. Further, it should be noted that the electrode system in this device uses substantially wide. Constant width silver buss bar conductor paths to carry the necessary current between the terminal connections and the electrode system. The wide conductors not only result in significant "cold" areas of the mirror along the length of the conductors, but also requires significant quantities of the precious metal silver which significantly adds to the cost of the device.

SUMMARY OF THE INVENTION

It is accordingly the object of the invention to provide for a heating device that maximizes the surface area of a mirror that is heated and also minimizes the use of silver conductor material by optimizing the size of the conductor paths.

According to the invention, there is an electrical buss system including a pair of buss bars to which are connected interdigitated conductor paths forming a plurality of electrodes disposed on a substrate over which a plurality of parallel spaced apart stripes of positive temperature coefficient resistive material is deposited so as to form a plurality of heater areas uniformly distributed over the surface of the substrate. The buss bars are adapted to provide an electrical resistance along their length resulting in a heating effect substantially matching the heating effect of the PTC material so as to achieve heating along the buss bars and eliminating "cold " spots.

According to an important feature, of the invention, the width of the PTC material stripes is varied in desired areas of the substrate so as to achieve desired power density and thus a desired heating effect at that area.

According to the invention, the buss bars are sized such that the power density at any location along the length of each buss bar substantially matches the average power density of all of the PTC material heating areas.

According to the invention, the buss bars are decreasingly tapered from their respective power terminals toward their free ends to achieve the desired power density distribution along their length.

Advantageously, the taper to the buss bars reduces the quantity of silver conductive material required, thereby minimizing the quantity of precious silver material required and minimizing the overall cost to manufacture the heater.

In another aspect of the invention, there is provided a plurality of heater-lets formed of an electrically resistive layer of material having a positive temperature coefficient. The plurality of heater-lets have varying sizes and shapes and are deposited over an electrical buss system between adjacent electrodes of interdigitated electrodes. Each of the plurality of heater-lets are separated from its neighbor by spaces of varying sizes and shapes so as to form a plurality of individual heating areas of variable intensity. The power distribution over the entire substrate is selectively regulated by varying the density of the heater-lets.

BRIEF DESCRIPTION OF THE DRAWINGS

The invention will be better understood after reading the following Detailed Description of the Preferred Embodiment in conjunction with the drawings of which:

FIG. 1 is a plan view of the heating device showing details of construction:

FIG. 2 is a vertical transverse cross sectional view through the heating device showing further details of construction:

FIG. 3 is a perspective view of a heating device according to the invention attached to the back side of an automotive-type rearview mirror to be heated;

DETAILED DESCRIPTION OF THE PREFERRED EMBODIMENTS

Figure 4:
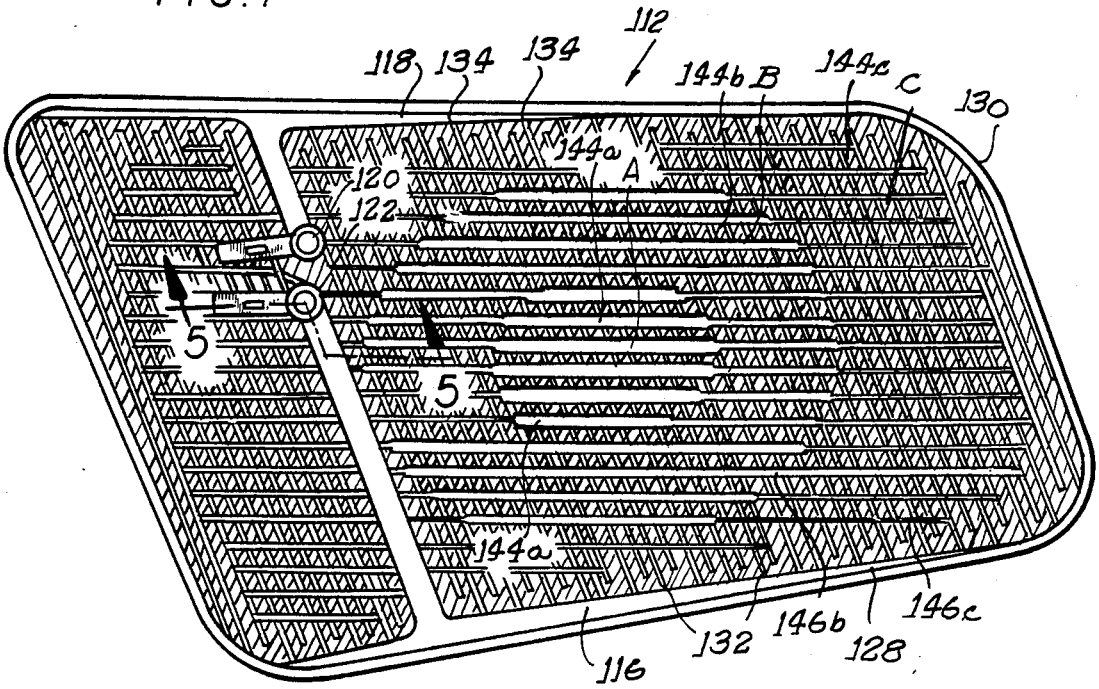
FIG. 4 is a plan view of another embodiment of the heating device showing details of its construction and FIG. 5 is a vertical transverse cross-sectional view taken along the lines 5—5 of FIG. 4 illustrating additional details of its construction.

Shown in FIG. 3 is an automotive-type outside rearview mirror 10 having a heating device 12 according to the invention attached to a back side. The heating device 12 according to the present invention can be used in any other application where a self regulating heater is desirable. The embodiment disclosed herein however is specifically adapted for use in an automotive-type outside rearview mirror application which is subject to fogging, frosting, icing over and to being covered with snow making it desirable to have a device for overcoming such environmental effects. Further, this application is particularly suited for heating a device subject to changing ambient temperatures due to its ability to automatically control the temperature as a function of the ambient temperature. That is, at elevated ambient temperatures, no heating is required, whereas at low ambient temperature, such as below freezing higher temperatures are desirable.

FIG. 1 and 2 show a preferred construction of the heating device 12. As shown in FIG. 2. the heating device comprises an electrically insulating substrate 14 of for example MYLAR of about 0.OO7 inches thickness. Deposited on one side of the substrate 14 is an electrical buss system, shown best in the plan view in FIG. 1. The buss system comprises a layer of printable, electrically conductive material preferably comprising an electrically conductive silver polymer such as the commercially available silver polymer 725 manufactured by Hunt Chemical. The conductive buss system layer is preferably deposited on the substrate in a thickness within the range of about 8 to 10 microns. The buss system further includes two buss bars 16, 18 each electrically connected to and extending from one of two terminals 20, 22 which each comprise an eyelet 24 secured in a hole 25 in contact with a respective one of the buss bars and a contact terminal member 26 adapted to connect to an external power supply. Each buss bar 16, 18 extends along substantially opposite portions of the peripheral edge of the substrate terminating in free ends 28, 30. Each buss bar is also tapered in decreasing area from its respective terminal connection toward its free end in a manner and for the purpose described herein below. Extending perpendicularly from each buss bar 16, 18 are a plurality of conductor paths, such as paths 32, 34, 36, 38, defining a plurality of spaced apart, parallel, intedigitated electrodes. That is, adjacent electrodes connect to opposite buss bars and extend in opposite parallel directions terminating spaced from the other buss bar.

Screen printed over the buss system is a layer of positive temperature coefficient electrically resistive material 40. The PTC material 40 is a screen printable PTC electrically conductive ink having a composition adjusted to have a desired electrical characteristic for the particular application. For example, for automotive outside rearview mirror applications, a preferred screen printable PTC material has been found to comprise an eythlene vinyl acetate co-polymer resin, such as Dupont 265 which comprises 28 percent vinyl acetate monomer and 72 percent eythlene monomer modified to have a sheet resistivity of 15,OOO ohms per square. To achieve this electrical characteristic, this eythlene vinyl acetate co-polymer resin is first dissolved in an aromatic hydrocarbon solvent such as naphtha, xylene or toluene at 80 degrees C. and let down to where 20 percent of the total weight of the solution is solids. Carbon black such as CABOT VULCAN PF is then added and mixed to bring the total solid content to 50 percent by weight. This material is then passed through a three roll dispersing mill having a 0.1 to 1 mil nip clearance to further disperse and crush the solids. The material is then further let down with a 2O% solids resin and solvent solution until the desired sheet resistivity is achieved. As noted, the PTC material is screen printed over the buss system and substrate in parallel spaced apart stripes perpendicular to the electrode pattern, as shown in FIG. 1, and preferably in a thickness of about 2.5–5 microns so as to form a plurality of individual heating areas, such as 42, 44 on the substrate.

When a voltage is applied across the terminals and thus across the electrode array, depending upon the ambient temperature and electrical characteristics of the PTC material, current will flow through the PTC material between the electrodes causing the individual heating areas to heat. As is known, the current flow and heating effect of the PTC material depends on its temperature which will change as the ambient temperature changes and, at a predetermined temperature of the PTC material, the resistivity of the material increases causing the material to no longer conduct current, whereby the heating areas no longer generate heat. Accordingly, it can be seen that the heating device is self regulating in accordanoe with the surrounding ambient temperature. It should be noted that the heating effect at any location on a heater is a function of the power density at that location which can be changed by changing the width of the PTC material stripe at that location. Accordingly, it is possible to increase or decrease the heating effect at any given area of the substrate in accordance with the specific thermodynamics of the application. For example, in automotive outside rearview mirror applications, heat loss from the mirror is greatest at the perimeter. Accordingly, the width of the PTC stripes can be increased, even to the point where adjoining stripes connect together as shown in FIG. 1, so as to increase the power density and heating affect at those areas. Similarly, the width of the PTC stripes can be decreased. For example at the center of the mirror where heat loss is the least.

The buss system includes a novel buss bar configuration. The current carrying requirements of each buss bar decreases with increasing distance from the power terminals. That is, the portion of each buss bar at, for example, location A in FIG. 1 must carry all of the current requirements for all of the heating areas on the substrate, whereas at location B in FIG. 1 the buss bar only needs to carry the current requirements for the last electrode pair in the system. Accordingly, if the buss bar size is maintained constant at, for example, a size sufficient to carry the maximum current requirement at location A, there will be little, if any resistance heating of the buss bar along its length. This is particularly true at increasing distances from the power terminals toward location B. That is, the buss bar at great distances from the terminals becomes increasingly oversized and will remain "cold " and there will be no electrical resistance heating effect in the area covered by the buss bars. The invention however, decreasingly tapers the buss bars from the power terminals to their free ends such that the power density at any location along the length of the buss bar is substantially equal to the average power density of all of the heating areas on the substrate. In this manner, the electrical resistance created by the sized buss bar will create a heating effect substantially the same as that created by the heating areas. It should be noted that one skilled in the art knowing the electrical characteristic of the PTC material, conductive silver and voltage available at the power terminals can readily calculate the average power density of the heater areas and thus the buss bar size at all locations required to achieve the average power density at all locations along its length. Accordingly, the entire substrate from the center out to the periphery, including those areas beneath the buss bars, will be heated with substantially no cold spots. It can be appreciated therefore that substantially the entire surface area of the mirror will be heated. Another advantage of the tapered buss bar is that the quantity of silver required is minimized with the corresponding cost savings.

Referring to FIG. 2, a layer of acrylic pressure sensitive adhesive 46 is deposited over the PTC material. Because the PTC material is deposited in stripes, the adhesive is able to flow down to and adhere to the exposed substrate areas 4B in the spaces between adjacent stripes of PTC material. The adhesive adheres significantly better to the MYLAR substrate than to the PTC material and the integrity of the bond is significantly increased. A second insulating barrier layer 50 oF MYLAR of about 0.001 inch in thickness is secured by the adhesive layer 46 and functions to environmentally seal the conductor and PTC material and to electrically insulate the conductors from possible shorting or arcing to the member on which it is mounted. For example, without the barrier layer 50, the conductors could come into contact with or arc to a silver backing on the mirror.

Another adhesive layer 52 is deposited on the barrier layer 50 and a removable protective covering 54, such as paper, is retained to the adhesive layer 52. To mount the heater on a mirror, the protective covering 54 is peeled off, the device is secured to the back of the mirror by the adhesive 52 and the power source is connected across the terminals 20, 22.

Figure 5:
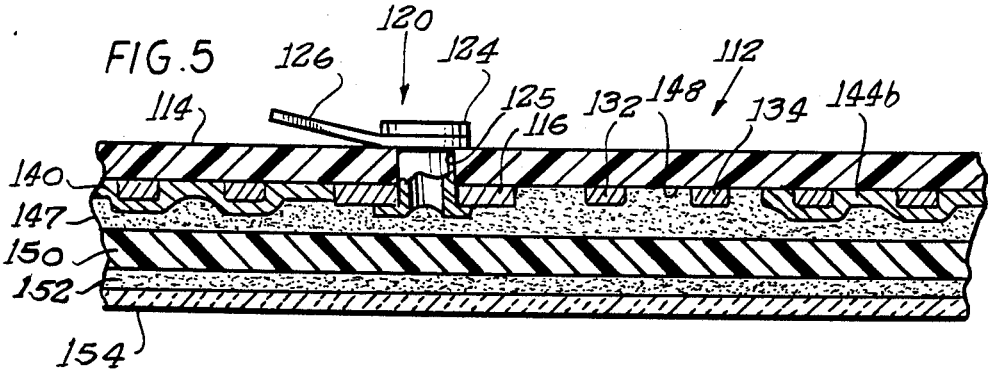

Another embodiment of the present invention is illustrated in FIGS. 4 and 5, where there is shown a positive temperature coefficient heater device 112 having a distributed heating capability. As can be seen from FIG. 5, the heater device 112 include an electrically insulating substrate 114 having an electrical buss system deposited on its one side. The buss system, as best seen from FIG. 4 is comprised of a layer of printable, electrically conductive material such as an electrically conductive silver polymer.

The buss system is formed of two major buss bars 116 and 118 which are electrically connected to and extend from corresponding terminals 120 and 122. Each of the terminals 120, 122 is provided with an eyelet 124 that is secured in a hole 125 in contact with a respective one of the major buss bars 116, 118 and a lug member 126 adapted to be connected to an external power supply. Each of the major buss bars 116, 118 extends along substantially opposite portions of the peripheral edge of the insulating substrate 114 and terminates at free ends 128, 130. Each of the buss bars 116, 118 is also tapered in decreasing area from its corresponding terminals 120, 122 toward its respective free ends 128. 130.

The buss system further includes a plurality of minor buss bars 132 defining a plurality of spaced apart, parallel, conductor paths extending perpendicularly to the major buss bar 116 and a plurality of minor buss bars 134 defining a plurality of spaced apart, parallel, conductor paths extending perpendicularly to the major buss bar 118. The buss bars 132 and 134 define interdigitated electrodes wherein each of the adjacent minor buss bars 132 and 134 are connected to the respective opposite major buss bars 116 and 118 and extend in opposite parallel directions terminating at a spaced apart distance from the other buss bar. As thus far described, the heating device 112 of FIG. 4 is substantially identical to the heating device 12 of FIG. 1.

As will be recalled with respect to the heating device 12 of FIG. 1, a layer of positive temperature coefficient electrically resistive material was then screen printed over the buss system and the substrate in parallel spaced apart stripes perpendicular to the interdigitated electrodes so as to form a plurality of individual heating areas 42, 44 on the substrate. However, all of the heating areas were substantially of the same physical size. Thus, the power density at any given location on the substrate was effectively the same. In order to provide improved localized heating distributions of varying intensity in or on selected portions of the substrate, the PCT stripes of FIG. 1 are replaced with a plurality of heater-lets **144*a*, 144*b*, 144*c* having varying sizes and shapes in FIG. 4. Each of the plurality of heater-lets is screen printed and consists of the PTC resistance material 140 similar to that of FIG. 1**.

As can best be seen in FIG. 4 each of the heater-lets **144*a*–144*c* is separated from its neighbor by spaces 146*a*, 146*b* and 146*c* of varying sizes and shapes. Each of the heater-lets 144*a*–144*c* thus functions independently as individual heating areas of variable intensity. The power is distributed to the plurality of heater-lets via the major buss bars 116, 118 and the minor buss bars 132, 134. The power generated from each of the heater-lets is a function of its physical geometry, its resistance at a particular temperature, and the voltage applied across the terminals 120, 122**. As the sizes of the heater-lets at a specific location is made larger so that the sizes of the spaces to its neighbor is made smaller, the greater the power will be generated. Therefore, the maximum power generated in a given area would be achieved by eliminating all of the spaces until there was only one large heater-let covering the entire area. On the other hand, the minimum power generated in a given area would be realized when there is eliminated all of the heater-lets and thus leaving one large space. Accordingly, the power distribution in a given heater device can be selectively regulated by varying the density of the heater-lets.

In FIG. 4, it can be seen that the plurality of heater-lets **144*a* and the plurality of spaces 146*a* in the center of the substrate 114 are configured in a pattern so as to form a general elliptically-shaped heating zone A. It should be noted that each of the heater-lets 144*a* within the zone A are substantially the same size and that each of the spaces 146*a* within the zone A are substantially the same size. The plurality of heater-lets 144*b* and the plurality of spaces 146*b* are designed in a pattern so as to form a general elliptically-shaped heating zone B, which is disposed coaxially with the zone A. Further, each of the heater-lets 144*b* within the zone B are substantially the same size and each of the spaces 146*b* within the zone B are substantially the same size. The plurality of heater-lets 144*c* and the plurality of spaces 146*c* are configured in a pattern so as to form a general elliptically-shaped heating zone C, which is disposed coaxially with the zone B. Each of the heater-lets 144*c* within the zone C are substantially the same size and each of the spaces 146*c*** within the zone C are substantially the same size.

Since the amount of power generated from each of the zones A, B, and C is determined by the density oF the heater-lets, it is possible to selectively control the heating effect within a particular area, i.e., a zone, by increasing or decreasing the number and sizes of the individual heater-lets within the zone. For example, since the heat loss from an automotive outside rearview mirror is progressively greater from the center out to the periphery, the relative sizes of the heater-lets going from zone A to zone C have been made progressively larger so as to compensate for the nonuniform heat transfer conditions, thereby permitting the entire surface of the mirror to be heated with uniform temperature distributions.

It should be clearly understood that the specific configuration of FIG. 4 shown and described above is merely exemplary. The invention broadly embraces the use of a plurality of heater-lets each functioning as an independent heating area of variable intensity having a pattern other than the specific form herein shown and described. While reference has been made herein to automotive-type outside rearview mirrors, the invention may be used for heating any number of other devices. Further, the heater-lets can be designed with a pattern so as to create a heater device having non-uniform temperature distributions rather than with uniform temperature distributions. It is also important to note that any number of zones having any shape may be used which should be distributed over the entire substrate in a desired manner so as to meet the specific needs of the particular application.

Referring now to FIG. 5, a layer of acrylic pressure sensitive adhesive 147 is deposited over the plurality of heater-lets (i.e., 144*b*) of the PTC material 140. The adhesive is able to flow down to and bond directly to the exposed substrate areas 148 in the plurality of spaces between the adjacent heater-lets. This relieves mechanical stress from the PTC material and reduces the dependency on the PTC material as an adhesive to hold the layers together, thereby increasing significantly its structural integrity. A second insulating barrier layer 150 of MYLAR is secured over the adhesive layer 147, and another adhesive layer 152 is deposited over the barrier layer 150.

A removable protective covering 154 is disposed over the adhesive layer 152. In order to mount the heater device 112 on a mirror, the protective covering 154 is peeled off and then secured to the back of the mirror by the adhesive 152. A power source is connected across the terminals 120, 122. It will be noted that the layers 114, 147, 150, 152 and 154 may be made of the same materials and have the same thicknesses as in FIG. 2. Further, these layers are assembled and function in a similar manner to FIG. 2.

Having described the preferred embodiment of the invention those skilled in the art having the benefit of the description and the accompanying drawings can readily devise other embodiments and modifications and such other embodiments and modifications are to be considered to be within the scope of appended claims.

What is claimed is:

1. A heating device comprising:

a planar electrically insulated substrate;

an electrical buss system on one surface of said substrate, including a pair of buss bars and two electrode patterns having a plurality of spaced apart parallel interdigitated electrodes, adjacent electrodes of said plurality of interdigitated electrodes connected to different ones of said pair of buss bars, each buss bar extending from one of a pair of terminal connection points along generally opposite portions of a peripheral edge of said substrate;

a plurality of heater-lets formed of an electrically resistive layer of material having a positive temperature coefficient, said plurality of heater-lets having varying sizes and shapes being deposited over said electrical buss system between adjacent electrodes of said interdigitated electrodes. each of said plurality of heater-lets being separated from its neighbor by spaces of varying sizes and shapes so as to form a plurality of individual heating areas of variable intensity; and at least one adhesive layer being deposited over said electrically resistive layer including the spaces between said heater-lets, said adhesive layer contacting and bonding directly to said substrate in areas of said substrate between said heater-lets, whereby the power distribution over the entire substrate is selectively regulated by varying the density of the heater-lets.

2. A heating device as claimed in claim 1, further including an electrically insulated barrier layer disposed on said adhesive layer.

3. A heating device as claimed in claim 2, further including a second adhesive layer disposed on said electrically insulated barrier layer.

4. A heating device as claimed in claim 3, further including a removable protective layer disposed on said second adhesive layer.

5. A heating device as claimed in claim 1, wherein predetermined one of said plurality of heater-lets have sizes at predetermined locations on said one surface of said substrate to form heating zones having predetermined power densities at said predetermined locations.

6. A heating device as claimed in claim 5, wherein said plurality of heater-lets at least along a portion of the peripheral edge of said substrate are larger in size than the other of said plurality of said heater-lets in the central portion of said substrate.

7. A heating device comprising;

a planar insulating substrate having a peripheral edge;

an electrical buss system deposited on one surface of said substrate, said buss system including two buss bars extending along generally opposite portions of the peripheral edge of said substrate, a plurality of parallel spaced apart interdigitated electrodes alternately connected to said buss bars defining a plurality of electrode paths:

a plurality of heater-lets formed of an electrically resistive layer of material having a positive temperature coefficient, said plurality of heater-lets having varying sizes and shapes being deposited over said electrical buss system between said adjacent electrodes of said interdigitated electrodes, each of said plurality of heater-lets being separated from its neighbor by spaces of varying sizes and shapes so as to form a plurality of individual heating areas of variable intensity;

first predetermined ones of heater-lets being arranged in a general elliptically-shaped pattern in the center of said substrate to form a first heating zone having a first predetermined power density;

second predetermined ones of said heater-lets being arranged in a general elliptically-shaped pattern and disposed coaxially with said first predetermined ones of said heater-lets to form a second heating zone having a .second predetermined power density; and third predetermined ones of said heater-lets being arranged in a general elliptically-shaped pattern and disposed coaxially with said second predetermined ones of said heater-lets to form a third heating zone having a third predetermined power density and at least one adhesive layer being deposited over said electrically resistive layer including the spaces between said heater-lets, said adhesive layer contacting and bonding directly to said substrate in areas of said substrate between said heater-lets.

whereby the power distribution over the entire substrate is selectively regulated by varying the density of the heater-lets in said first through third heating zones.

8. A heating device as claimed in claim 7, wherein the sizes of said second predetermined ones of said heater-lets are larger than the sizes of said first predetermined ones of said heater-lets so that the second power density of said second heating zone is higher than the first predetermined power density of said first heating zone.

9. A heating device as claimed in claim 8, wherein the sizes of said third predetermined ones of said heater-lets are larger than the sizes of said second predetermined ones of said heater-lets so that the third power density of said third heating zone is higher than the second predetermined power density of said second heating zone.

10. A heating device as claimed in claim 9, further including an electrically insulated barrier layer disposed on said adhesive layer.

11. A heating device as claimed in claim 10, further including a second adhesive layer disposed on said electrically insulated barrier layer.

12. A heating device as claimed in claim 11, further including a removable protective layer disposed on said second adhesive layer.

13. A planar heating device for attachment to a member to be heated comprising;

an electrically insulated substrate having a predetermined shape conforming to the member to be heated;

an electrical buss system on one surface of said substrate, including a pair of buss bars and two electrode patterns having a plurality of spaced apart parallel interdigitated electrodes, adjacent electrodes of said plurality of interdigitated electrodes connected to different ones of said pair of buss bars, each buss bar extending from one of a pair of terminal connection points along generally opposite portions of a peripheral edge of said substrate;

a plurality of heater-lets formed of an electrically resistive layer of material having a positive temperature coefficient, said plurality of heater-lets having varying sizes and shapes being deposited over said electrical buss system between adjacent electrodes of said interdigitated electrodes, each of said plurality of heater-lets being separated from its neighbor by spaces of varying sizes and shapes so as to form a plurality of individual heating areas of variable intensity; and at least one adhesive layer being deposited over said electrically resistive layer including the spaces between said heater-lets, said adhesive layer contacting and bonding directly to said substrate in areas of said substrate between said heater-lets, whereby the power distribution over the entire substrate is selectively regulated by varying the density of the heater-lets.

* * * * *